US009067339B2

(12) United States Patent
Mallet

(10) Patent No.: US 9,067,339 B2
(45) Date of Patent: Jun. 30, 2015

(54) CARRIAGE FOR CUTTING A SHEET OF GYPSUM BOARD, CUTTING KIT AND METHOD FOR IMPLEMENTING SAME

(76) Inventor: Benoit Mallet, Evreux (FR)

( * ) Notice: Subject to any disclaimer, the term of this patent is extended or adjusted under 35 U.S.C. 154(b) by 435 days.

(21) Appl. No.: 13/642,378

(22) PCT Filed: Apr. 18, 2011

(86) PCT No.: PCT/IB2011/051674

§ 371 (c)(1),
(2), (4) Date: Feb. 8, 2013

(87) PCT Pub. No.: WO2012/020330

PCT Pub. Date: Feb. 16, 2012

(65) Prior Publication Data

US 2013/0126574 A1 May 23, 2013

(30) Foreign Application Priority Data

Apr. 21, 2010 (FR) ..... 10 01701

(51) Int. Cl.
*B28D 1/00* (2006.01)
*B28D 1/22* (2006.01)
*B26D 3/08* (2006.01)

(52) U.S. Cl.
CPC ..... *B28D 1/228* (2013.01); *B26D 3/085* (2013.01)

(58) Field of Classification Search
CPC ..... B28D 1/228; B26D 3/085
USPC ..... 83/523, 524, 564, 879, 713, 730, 472, 83/574
See application file for complete search history.

(56) References Cited

U.S. PATENT DOCUMENTS

| | | | | | |
|---|---|---|---|---|---|
| 513,851 | A | * | 1/1894 | Wheeler | 83/452 |
| 1,589,156 | A | * | 6/1926 | Hartman | 30/294 |
| 2,243,778 | A | * | 5/1941 | Stansel | 451/558 |
| 2,520,000 | A | * | 8/1950 | Dettman | 83/879 |
| 3,037,278 | A | * | 6/1962 | Genetti, Sr. | 30/2 |
| 3,478,427 | A | * | 11/1969 | Tims, Jr. | 30/293 |
| 3,527,131 | A | * | 9/1970 | Ellerin et al. | 83/522.19 |
| 3,774,495 | A | * | 11/1973 | Matthew | 83/522.19 |
| 3,963,159 | A | * | 6/1976 | Krulwich | 225/96.5 |

(Continued)

OTHER PUBLICATIONS

International Search Report and Written Opinion of the International Searching Authority for Application No. PCT/IB201/051674.

*Primary Examiner* — Sean Michalski
(74) *Attorney, Agent, or Firm* — Alston & Bird LLP

(57) ABSTRACT

The invention proposes a solution for cutting a sheet of gypsum board quickly and allowing a flat cut edge to be obtained. The invention relates to a carriage comprising a chassis (101) fitted with: —means (102) for collaborating in a sliding manner with a cutting guide (200); —a handle (110) that can rotate with respect of the chassis (101) and comprises a means (111) for grasping, a retractable engagement claw (113) and a housing (112) to hold a blade (300); —a section piece (120) provided with at least three notches (A, B, C) in which to lock the rotation of the handle through reversible engagement of the claw, the notches being arranged such that: •the first notch (A) allows the blade to be retracted so that it is not in contact with the sheet; •the second notch (B) allows the blade to be arranged at an angle α to the sheet of gypsum board, in firm enough contact with the sheet to score it in order to form a cutting edge; •the third notch (C) allows the blade to be arranged at an angle β to the sheet of gypsum board in firm enough contact with the sheet to trim the cutting edge.

19 Claims, 9 Drawing Sheets

(56) References Cited

U.S. PATENT DOCUMENTS

Figure 1:
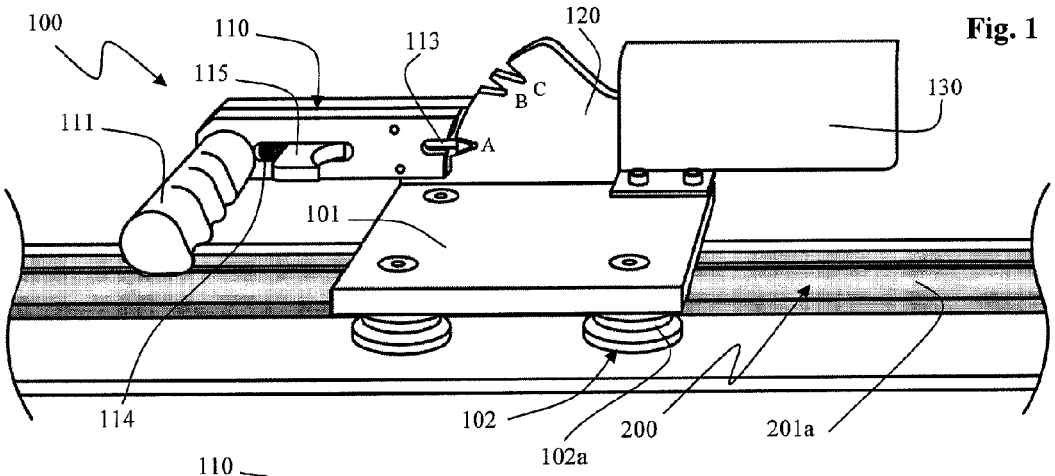

| | | | | | |
|---|---|---|---|---|---|
| 3,973,459 | A * | 8/1976 | Stowe | 83/455 |
| 3,996,827 | A * | 12/1976 | Logan | 83/455 |
| 4,022,095 | A * | 5/1977 | Jones | 83/455 |
| 4,036,486 | A * | 7/1977 | Molpus | 269/303 |
| 4,094,217 | A * | 6/1978 | Exline | 83/879 |
| 4,096,631 | A * | 6/1978 | Ward | 30/294 |
| 4,148,142 | A * | 4/1979 | Sullivan et al. | 30/293 |
| 4,158,977 | A * | 6/1979 | Logan | 83/522.16 |
| 4,443,942 | A * | 4/1984 | Demeter | 30/293 |
| 4,495,697 | A * | 1/1985 | Ruff | 30/294 |
| 4,506,576 | A * | 3/1985 | Crawford et al. | 83/455 |
| 4,545,515 | A * | 10/1985 | Kozyrski | 225/96.5 |
| 4,570,516 | A * | 2/1986 | Bruns | 83/455 |
| 4,641,556 | A * | 2/1987 | Vigneron et al. | 83/36 |
| 4,649,647 | A * | 3/1987 | Kaulfuss | 30/293 |
| 4,685,366 | A * | 8/1987 | Beder | 83/455 |
| 4,694,722 | A * | 9/1987 | Collier et al. | 83/885 |
| 4,798,112 | A * | 1/1989 | Kozyrski et al. | 83/455 |
| 4,858,507 | A * | 8/1989 | Evans et al. | 83/455 |
| 4,867,023 | A * | 9/1989 | Kozyrski et al. | 83/455 |
| 4,939,968 | A * | 7/1990 | Stoof | 83/886 |
| 4,949,462 | A * | 8/1990 | Spencer | 30/293 |
| 5,094,134 | A * | 3/1992 | Mizukoshi | 83/698.21 |
| 5,161,445 | A * | 11/1992 | Kozyrski et al. | 83/455 |
| 5,168,788 | A * | 12/1992 | Kozyrski et al. | 83/863 |
| 5,265,511 | A * | 11/1993 | Itzov | 83/490 |
| 5,309,642 | A * | 5/1994 | McGinnis | 33/32.2 |
| 5,471,753 | A * | 12/1995 | Rodrigues | 33/42 |
| 5,603,253 | A * | 2/1997 | Logan | 83/875 |
| 5,732,472 | A * | 3/1998 | Praye | 33/42 |
| 5,946,999 | A * | 9/1999 | Kahn | 83/879 |
| 5,996,237 | A * | 12/1999 | Sanders | 33/42 |
| 6,079,297 | A * | 6/2000 | Chandler et al. | 81/9.51 |
| 6,334,259 | B1 * | 1/2002 | Harvey | 33/42 |
| 6,757,981 | B2 * | 7/2004 | Hampton | 30/372 |
| 7,059,225 | B1 * | 6/2006 | Rabell | 83/13 |
| 7,370,426 | B2 * | 5/2008 | Choi | 33/42 |
| 7,886,447 | B2 * | 2/2011 | Cruz | 33/41.5 |
| 8,020,312 | B1 * | 9/2011 | McGahan | 33/770 |
| 8,245,540 | B2 * | 8/2012 | Abramov et al. | 65/105 |
| 8,434,235 | B2 * | 5/2013 | Carter | 30/293 |
| 8,819,954 | B1 * | 9/2014 | Fernandez | 33/668 |
| 8,856,995 | B2 * | 10/2014 | Arvinte et al. | 7/165 |
| 8,915,662 | B2 * | 12/2014 | Kildevaeld | 401/25 |
| 2002/0096031 | A1 * | 7/2002 | Yang | 83/614 |
| 2005/0279199 | A1 * | 12/2005 | Bavelloni | 83/13 |
| 2006/0201000 | A1 * | 9/2006 | McCallum | 30/293 |
| 2009/0107316 | A1 * | 4/2009 | Thomas | 83/471.3 |
| 2009/0241346 | A1 | 10/2009 | Bilenski | |
| 2009/0298663 | A1 * | 12/2009 | Crick | 493/396 |
| 2010/0252601 | A1 * | 10/2010 | Thibault | 225/106 |
| 2011/0179929 | A1 * | 7/2011 | Angel | 83/614 |
| 2012/0125173 | A1 * | 5/2012 | Nelson et al. | 83/886 |
| 2013/0126574 | A1 * | 5/2013 | Mallet | 225/2 |
| 2013/0160630 | A1 * | 6/2013 | Groth | 83/743 |

* cited by examiner

Fig. 23
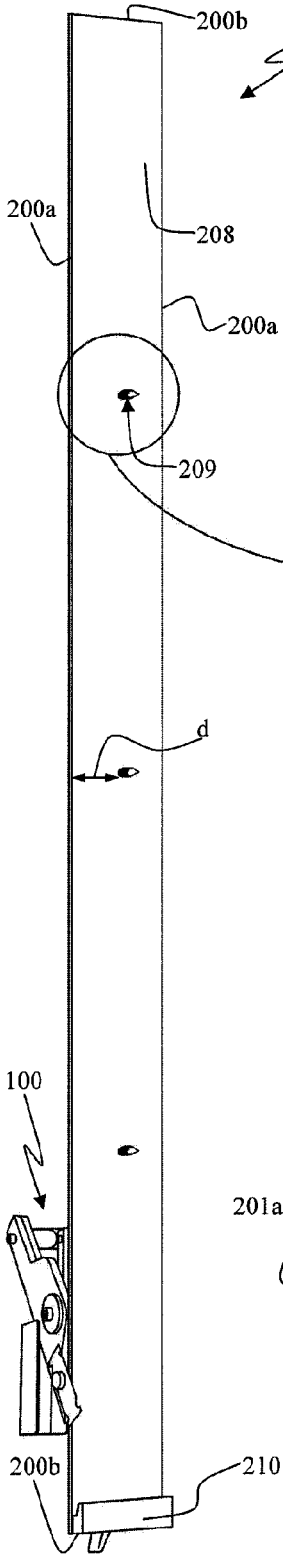
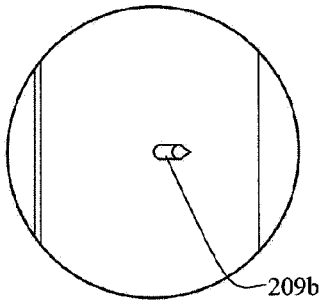
Fig. 25
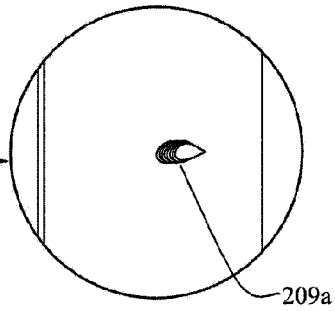
Fig. 24
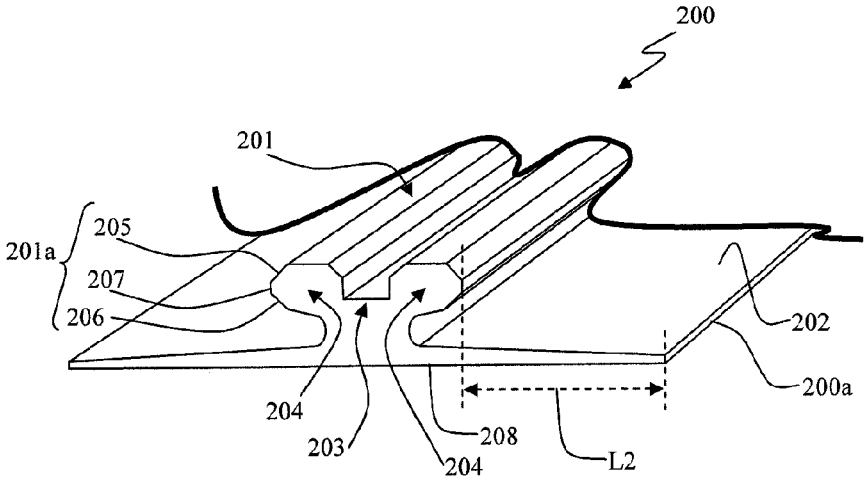
Fig. 22

CARRIAGE FOR CUTTING A SHEET OF GYPSUM BOARD, CUTTING KIT AND METHOD FOR IMPLEMENTING SAME

FIELD OF THE INVENTION

The invention relates to a carriage for cutting a sheet of plasterboard, to a cutting kit and to a method for implementing the kit.

BACKGROUND OF THE INVENTION

A sheet of plasterboard is a sheet made of a layer of plaster covered, on at least one face, by a sheet of cardboard or of paper. Generally, the two faces of the sheet are covered by a sheet of cardboard or of paper.

The sheets of plasterboard are generally manufactured in a factory, and are used to make partitions, ceilings, to line rough walls, etc. These sheets therefore replace the use of powder plaster dissolved in water in order to coat walls, which is a tiring and lengthy operation and which requires significant know-how to obtain an optimum composition of the plaster and a satisfactory flatness of the coated surface.

These sheets have the advantage of being easy to manipulate and of allowing for rapid work. Furthermore, less know-how is needed to position them compared to traditional plaster. Finally, the factory production makes it possible to obtain plasters of optimal composition. However, for cost and management issues, the factory production entails producing sheets of standard sizes.

Although there are different standard dimensions, in length and in width and in thickness, it is often necessary to cut these sheets to adapt them to the widths and lengths of the walls or of the ceiling of the room in which they are to be installed.

This cutting, done on the work site to the ideal dimensions, has to be rapid and as clean as possible to allow for two sheets to be easily positioned contiguously.

Then, a finishing has to be carried out by filling the interstice between two contiguous sheets of plaster, using a filler product such as plaster or ready-to-use coating. Once applied, this filling product is smoothed using the coating knife.

The finishing step has to be as rapid as possible. For this, the number of gestures required of the user has to be limited. A clean cutting of the sheets would make it possible not only to limit the quantity of filler product used, but also the number of gestures to be made to smooth the surface on and in the vicinity of the interstice.

There are a number of solutions for cutting a sheet of plasterboard.

Figure 13:
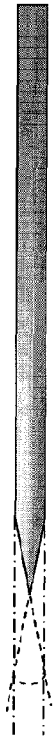

The most widely used consists in "marking" the sheet with a cutter blade (a cutter blade, known from the prior art and illustrated in FIG. 13, consists of a plate having a doubly beveled edge, that is to say that both faces of the plate are beveled).

This operation makes it possible to cut the first sheet of cardboard and score the layer of plaster. Then, the operator exerts a stress on the sheet so that the layer of plaster is broken into two parts along the score. Finally, the operator cuts the second sheet of cardboard with his cutter to free the two sheet parts. Generally, in this last step, the second sheet of paper is torn rather than cut, which creates an irregularity on the surface of the sheet of plasterboard that has to be filled in the finishing stage.

This solution is dangerous for the operator because of the use of the cutter. In practice, the scoring obtained is never rectilinear, even with the use of a guide, and it often happens that the speed of the scoring movement results in a sudden deviation of the blade of the cutter from the guide to the body of the user.

It is for this reason that some companies prohibit their workers from using this practice. Some public institutions even prohibit this practice in their calls for bids, but in practice it is the method most widely used.

Moreover, this solution also has two technical drawbacks. Firstly, the use of a blade of the cutter generates non-rectilinear scores so that the break along the surface of the sheet can take forms that are so irregular that a new sheet has to be used and cut. Secondly, the cutting edge, obtained after having broken the layer of plaster, is still very uneven, in that the cutting edge obtained has numerous protuberances, even with a user with long experience. It is then difficult to fit two contiguous sheets whose cutting edge is uneven. It is also necessary, during the finishing stages, to use a significant quantity of filler material to obtain a perfectly planar surface between the two consecutive sheets.

To overcome this problem, some operators have proposed a second cutting solution consisting in using a straight-back hand saw or a pad saw. The teeth of the blade of this saw has to be chosen with care to avoid plaster chips and generating an uneven cutting edge. For the same reason, the cutting speed and frequency must also be suitable, which requires significant know-how.

When well done, this second cutting solution makes it possible to obtain a clean cutting edge. Nevertheless, this solution takes longer than manual cutting using the cutter. Furthermore, the plasterboard sheets of small thickness (less than or equal to 18 millimeters) are unsuited to the use of a saw. This solution becomes advantageous only for thicknesses greater than 20 millimeters because, beyond this thickness, the strain to be exerted to break the layer of plaster is too great and the break does not necessarily follow the score.

The aim of the present invention is therefore to propose a rapid and clean solution for cutting a plasterboard sheet.

SUMMARY OF THE INVENTION

For this, the invention proposes using a carriage supporting a cutting blade making it possible, on the one hand, to firmly secure the blade during the scoring so that the break along the surface of the sheet is rectilinear and, on the other hand, to perform a step of trimming the edge of the sheet after having broken the layer of plaster.

To this end, the subject of the invention is a carriage for cutting a sheet of plasterboard, the carriage comprising a chassis provided with:

- means for cooperating in a sliding manner, in use, with a cutting guide;
- a handle, mounted to rotate relative to the chassis, and comprising a gripping means, a recess for a cutting blade and a retractable engaging claw;
- a section piece provided with at least three notches for blocking the rotation of the handle in three angular positions by a reversible engagement of the retractable claw, the notches being arranged on the section piece such that, in use:
  - the first notch allows the blade to be retracted away from contact with the sheet of plasterboard;
  - the second notch allows the blade to be arranged at an angle $\alpha$ with the sheet of plasterboard, with sufficient contact with the sheet of plasterboard to score it in order to form a cutting edge;

the third notch allows the blade to be arranged at an angle β with the sheet of plasterboard, with sufficient contact with the sheet of plasterboard to trim the cutting edge.

According to other embodiments:

the retractable engaging claw can be linked to a tension spring pressing, in the rest position, the claw into a notch;

the carriage may also comprise a blade protection housing, when the claw is engaged in the first notch;

the third notch can be spaced apart from the second notch to allow for the trimming of a cutting edge of a sheet of plasterboard of a first thickness;

the carriage may comprise at least one additional notch at a distance from the third notch to enable the trimming of a cutting edge of a sheet of plasterboard of at least one second thickness;

the recess may contain a cutting blade comprising at least one scoring corner having a planar face and a beveled face, extended by at least one trimming edge having a planar face and a beveled face that are identical to those of the scoring corner;

the blade may also comprise at least one cutting notch arranged between the scoring corner and the trimming edge;

the beveled face of the blade may form an angle with the planar face of between 15° and 25°, preferably 20°;

the trimming edge may have a length greater than the thickness of the sheet of plasterboard;

the cutting notch may be curved; and/or the blade may consist of a rectangular removable plate having two faces and comprising:

four scoring corners;

four cutting notches;

four trimming edges, two diametrically opposite scoring corners being symmetrical relative to the center of the rectangular plate, two consecutive scoring corners having a planar face and a beveled face that are opposite.

The invention also relates to a kit for cutting a sheet of plasterboard, comprising:

a carriage according to the invention;

a cutting blade comprising at least one scoring corner having a planar face and a beveled face, extended by at least one trimming edge having a planar face and a beveled face that are identical to those of the corner;

a cutting guide having two longitudinal edges and two ends, and comprising at least one rail suitable for cooperating in a sliding manner, in use, with the carriage provided with the cutting blade in order, in use, to guide the cutting blade in a manner parallel to the guide, and comprising, at least at one end of the rail, an abutment mounted to rotate and of profile section to secure, in use, the sheet of plasterboard.

According to other embodiments:

the cutting kit may comprise:

a carriage bearing a cutting blade comprising at least one scoring corner having a planar face and a beveled face, extended by at least one trimming edge having a planar face and a beveled edge that are identical to those of the corner;

a cutting guide having two longitudinal edges and two ends, and comprising at least one rail suitable for cooperating in a sliding manner, in use, with the carriage provided with the cutting blade in order, in use, to guide the cutting blade in a manner parallel to the guide, and comprising, at least at one end of the rail, an abutment mounted to rotate and of profiled section to secure, in use, the sheet of plasterboard;

the rail and the abutment may be provided with means for securing the abutment on the sheet of plasterboard;

the securing means may be spikes intended to be driven into the sheet of plasterboard;

the guide may also comprise, at at least one of its ends, a retractable stop means to allow, in use, for the coupling and decoupling of the rail with respect to the carriage;

the guide may comprise, at at least one of its ends, a means for damping, in use, the sliding at the end of travel of the carriage; and/or the abutment may comprise two parts linked to one another by an articulation, the two articulated parts being provided with means for securing the sheet of plasterboard, the articulation comprising an end-of-rotation abutment allowing a relative rotation of the articulated parts up to 45 degrees, preferably up to 30 degrees.

The invention also relates to a method for implementing a kit according to the invention, for cutting a sheet of plasterboard, comprising the following steps:

a) providing a sheet of plasterboard comprising a layer of plaster and at least one sheet of cardboard or of paper;

b) having the carriage cooperate in a sliding manner with the cutting guide;

c) arranging the cutting guide between two edges of the sheet in a determined cutting direction, and placing the carriage at a first edge of the sheet;

d) actuating the retractable engaging claw to withdraw it from the notch in which it is engaged and pivoting the handle until the claw can be engaged in the second notch, so that the scoring corner of the blade is applied to the sheet;

e) displacing the carriage using the gripping means to score the layer of plaster along the determined cut, from the first edge of the sheet to the second edge of the sheet;

f) bending the sheet along the score obtained in the preceding step to break the layer of plaster along the score and obtain a cutting edge;

g) displacing the carriage using the gripping means to the first edge of the sheet;

h) actuating the retractable engaging claw to withdraw it from the second notch and pivot the handle until the claw can be engaged in the third notch, so that the trimming edge is applied against the cutting edge obtained in the step f);

i) displacing the carriage using the gripping means to trim the cutting edge, from the first edge of the sheet to the second edge of the sheet, the step e) and/or the step i) comprising a cutting of said at least one sheet of cardboard or of paper of the sheet of plasterboard.

BRIEF DESCRIPTION OF THE SEVERAL VIEWS OF THE DRAWING(S)

Figure 2:
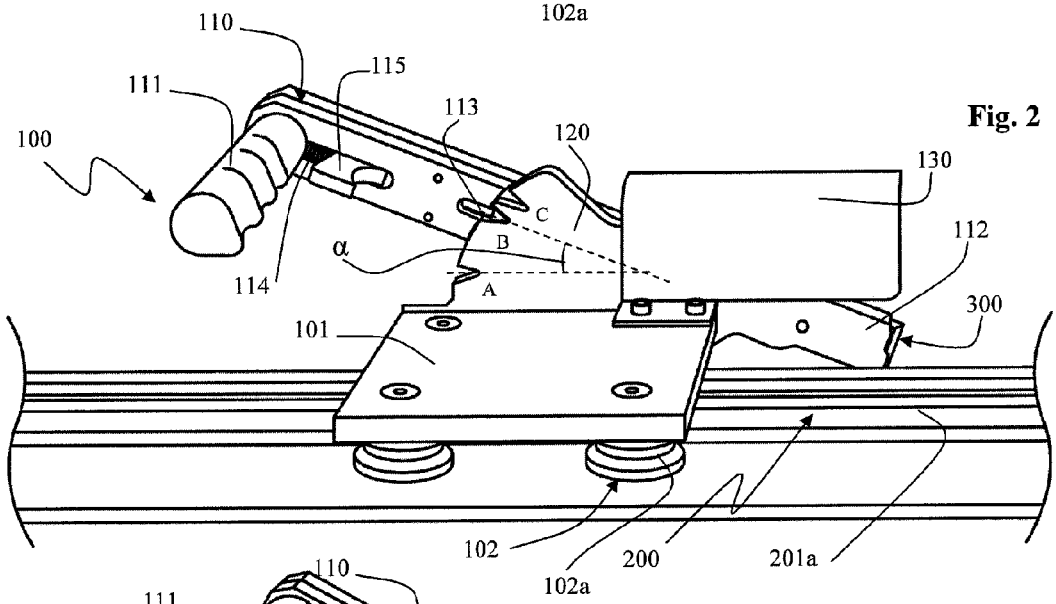
Figure 3:
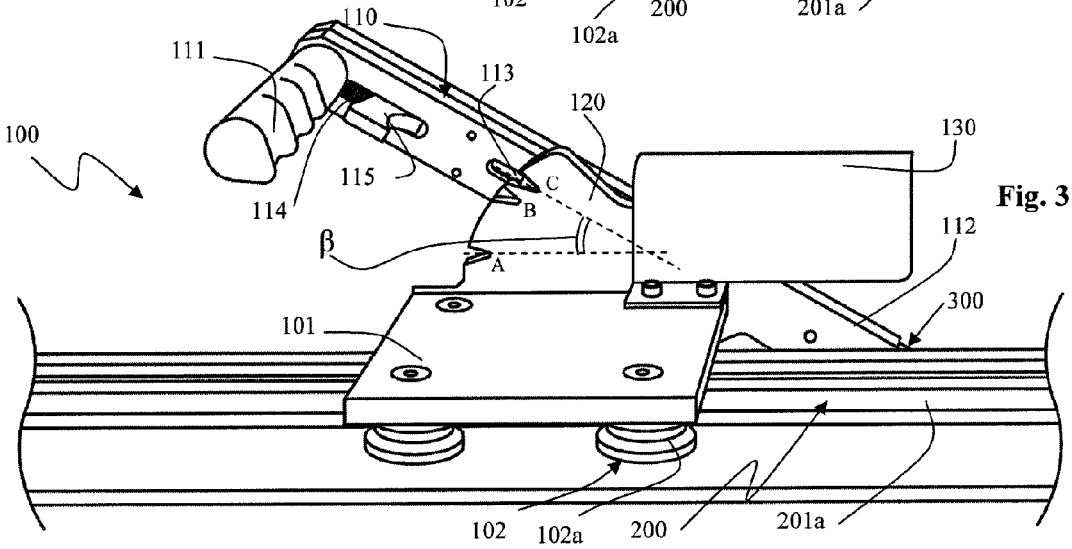
Figure 4:
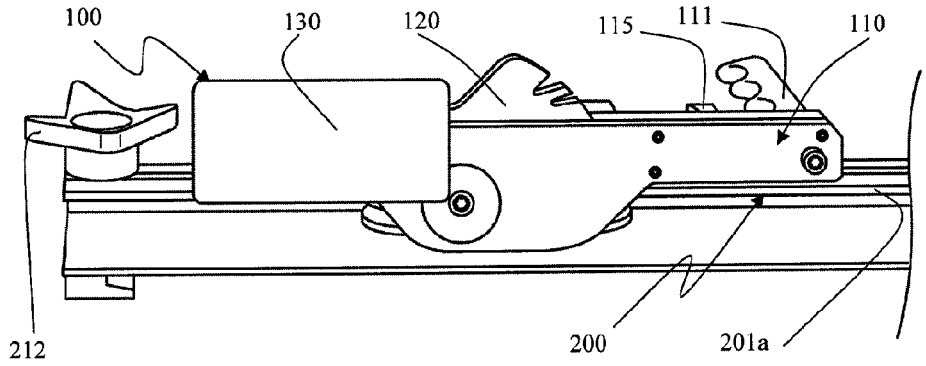
Figure 5:
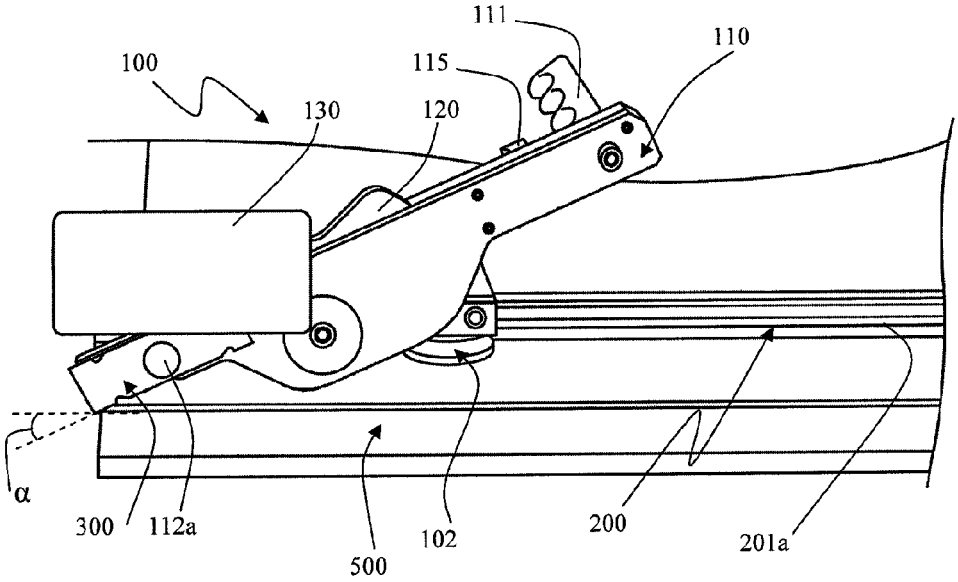
Figure 6:
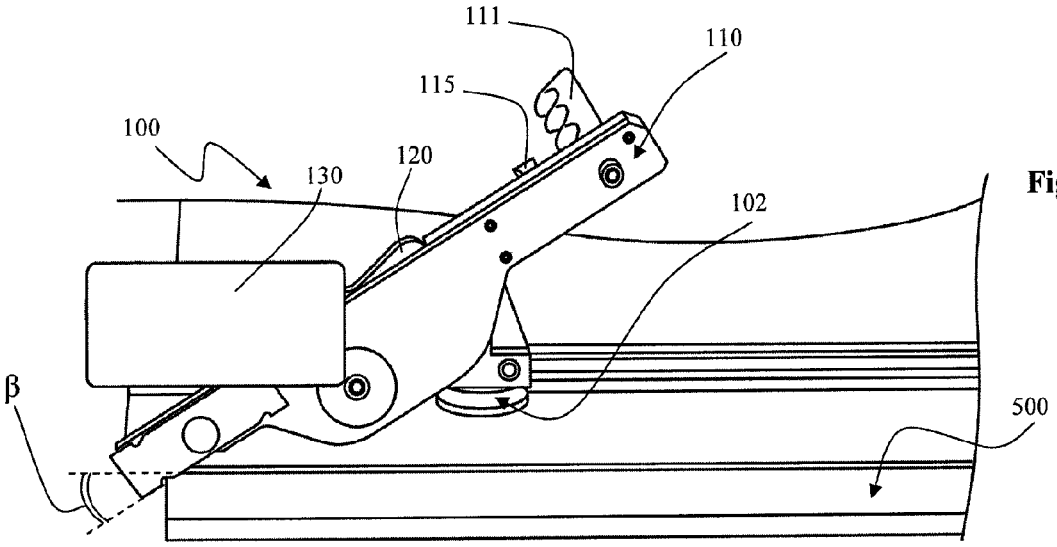
Figures 10, 11:
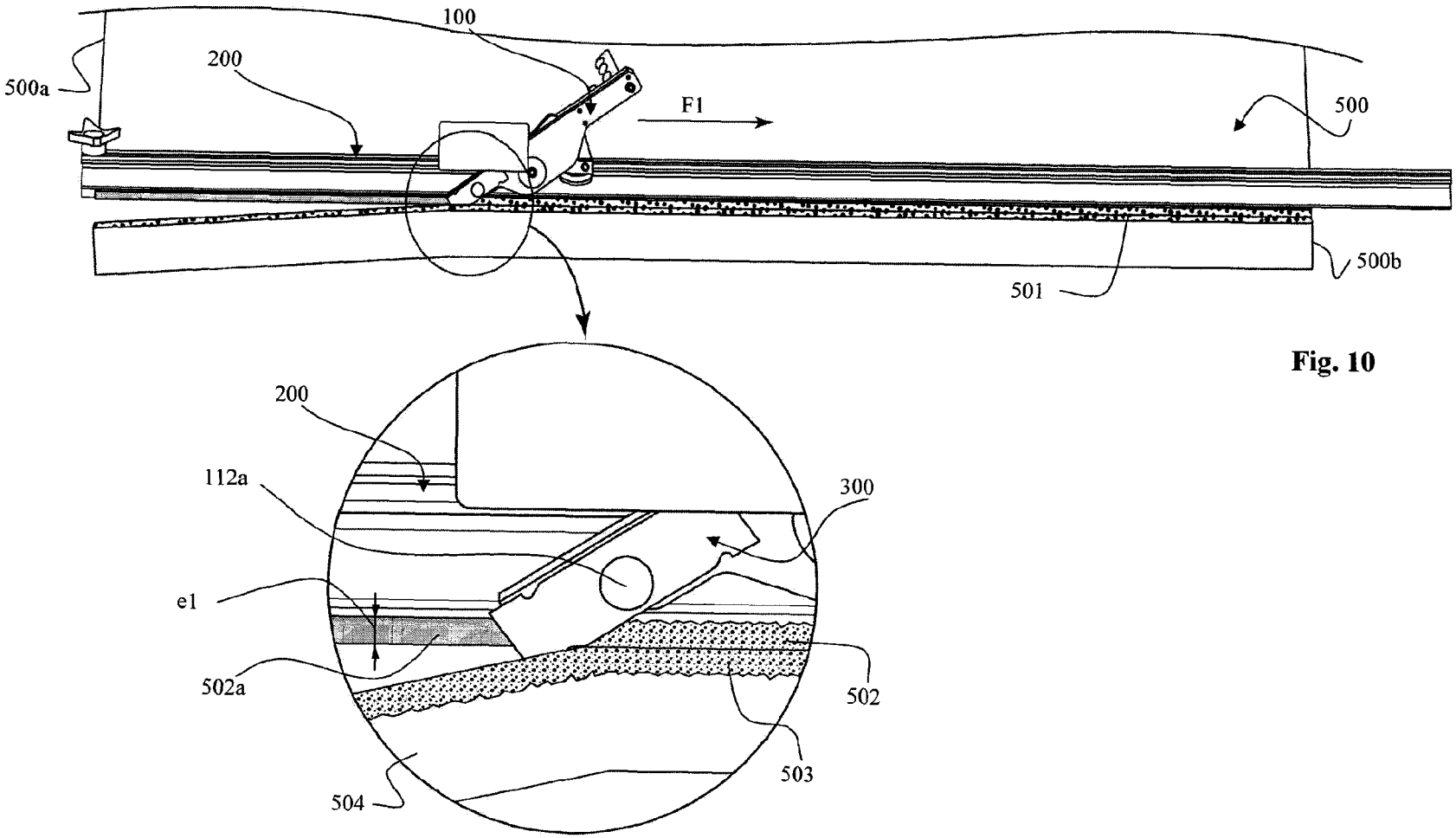
Figure 12:
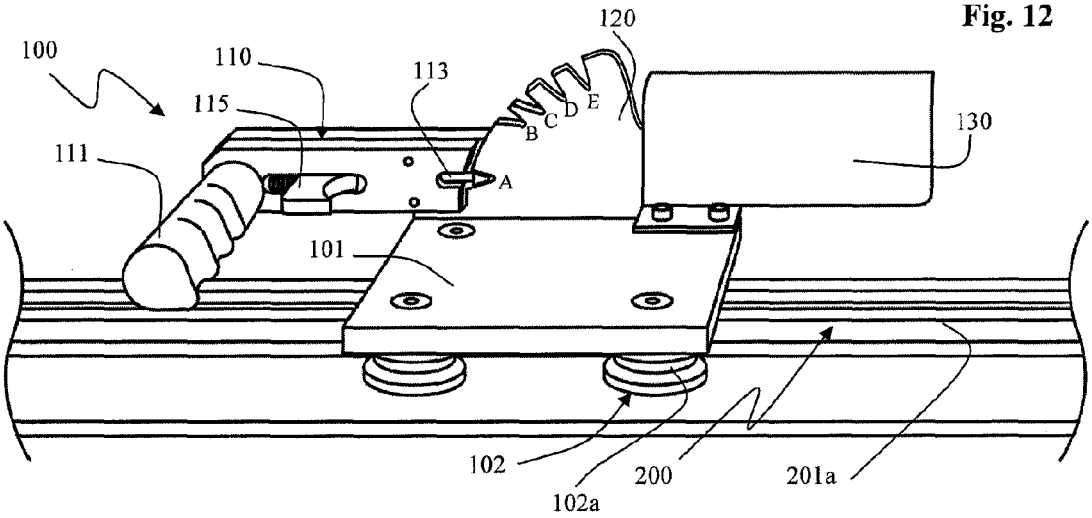
Figure 14:
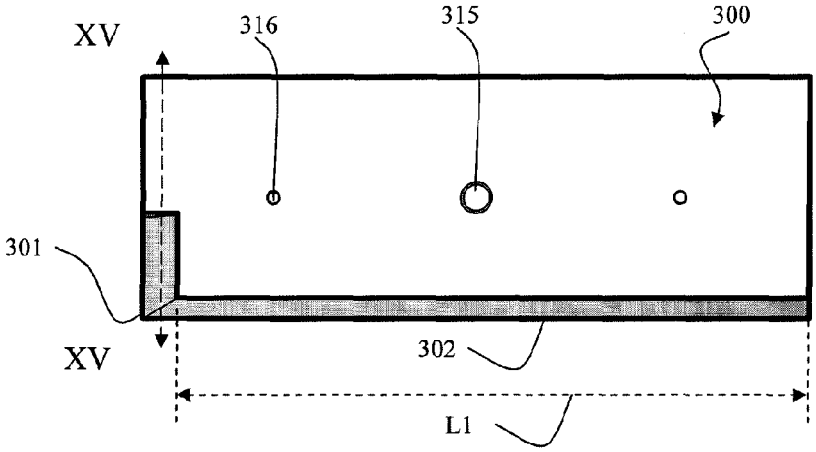
Figure 14A:
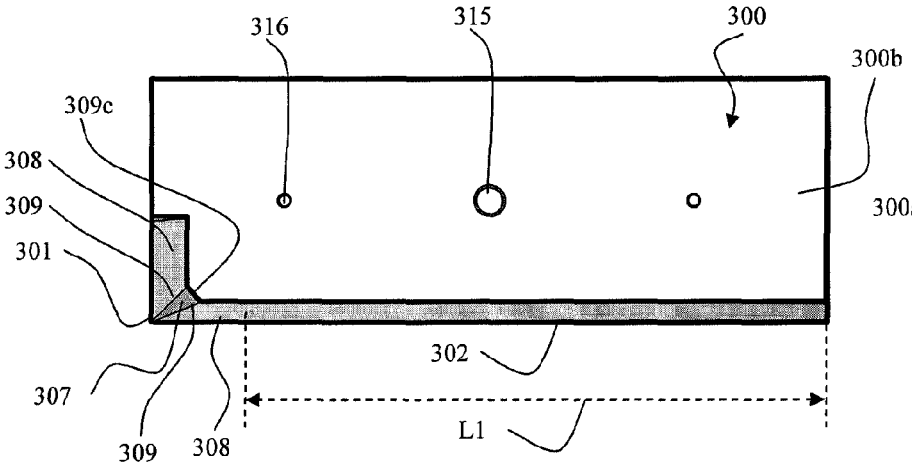
Figure 15:
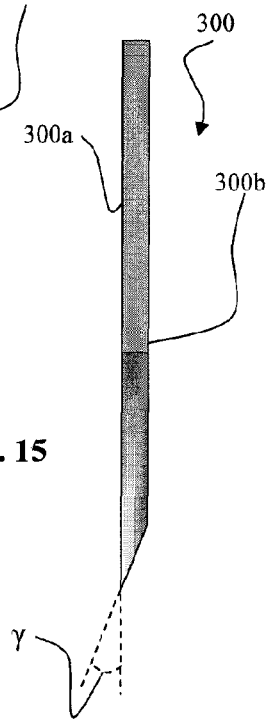
Figure 16:
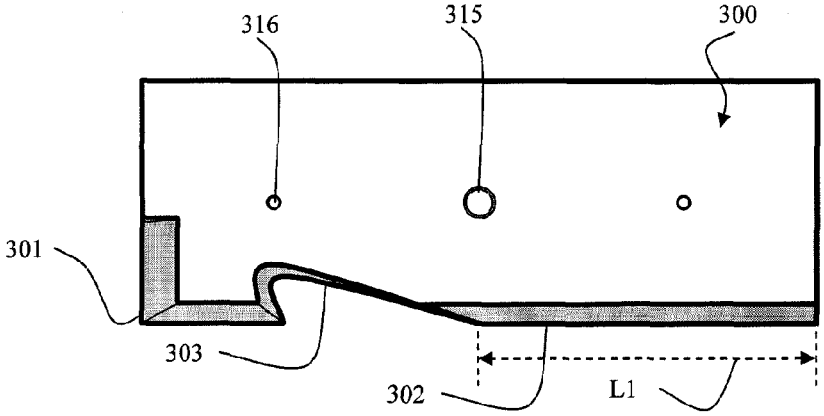
Figure 17:
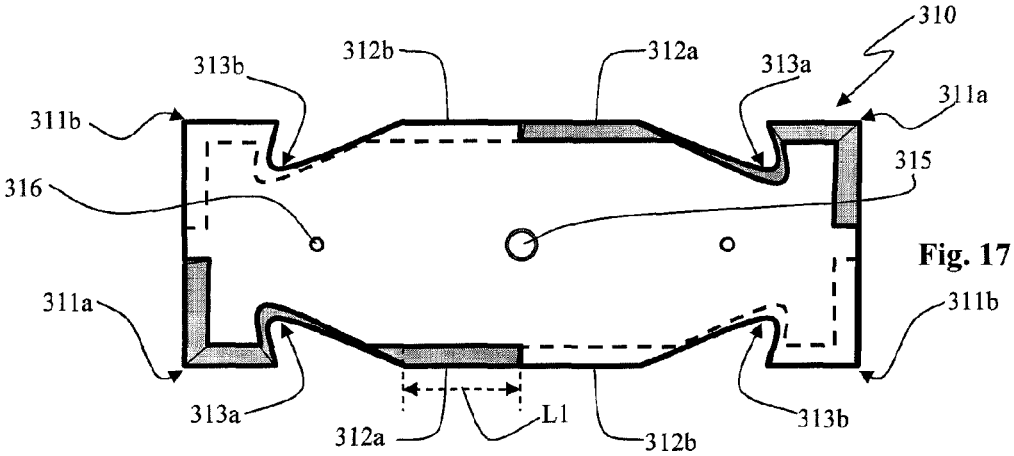
Figure 18:
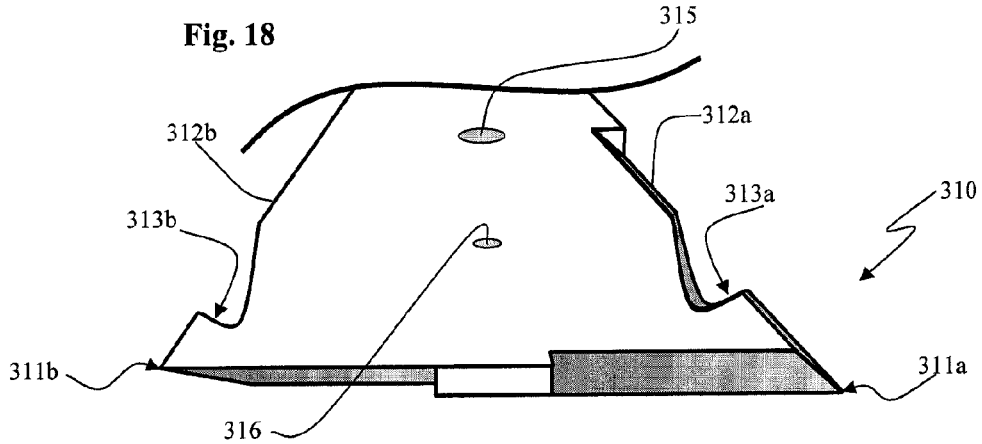
Figure 19:
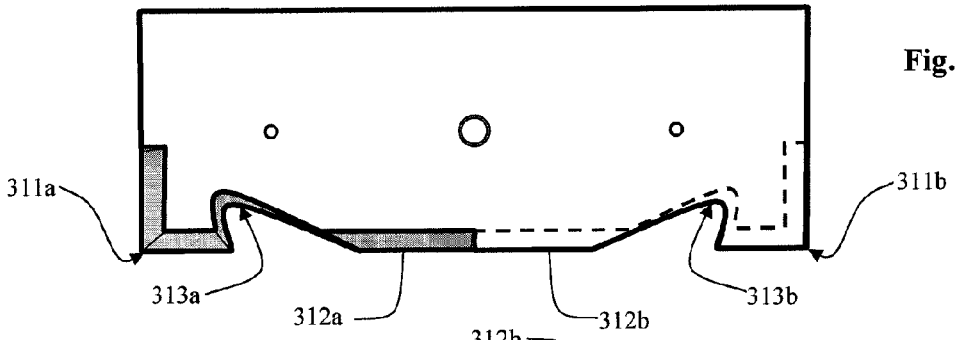
Figure 20:
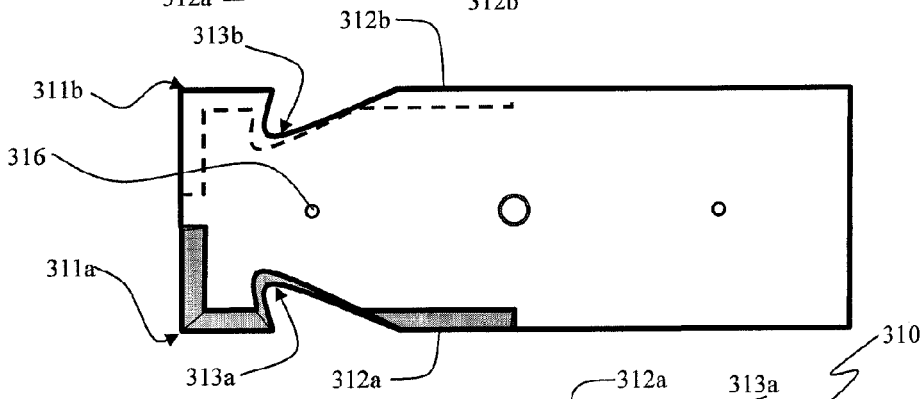
Figure 21:
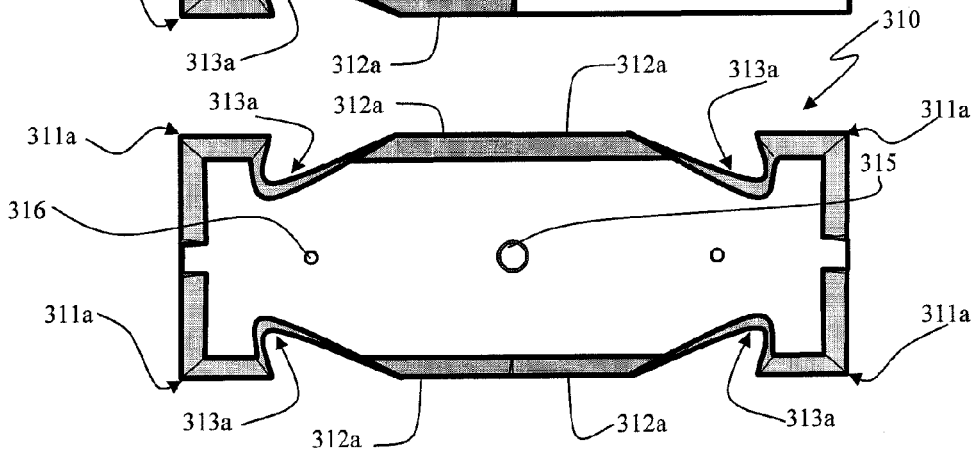
Figure 26:
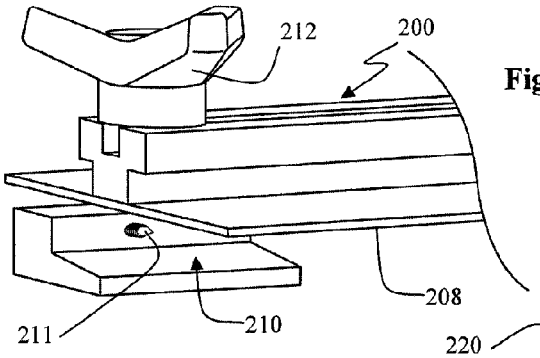
Figure 27:
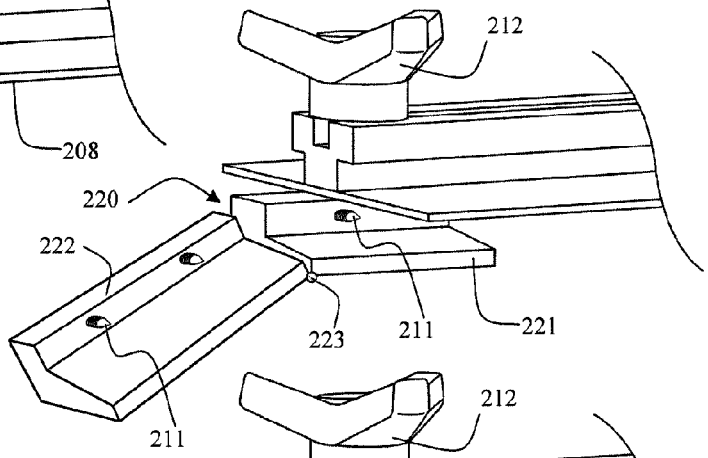
Figure 28:
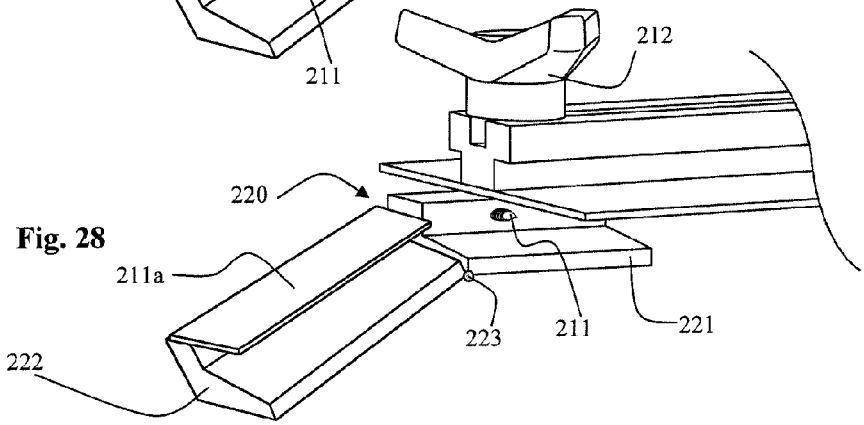
Figure 29:
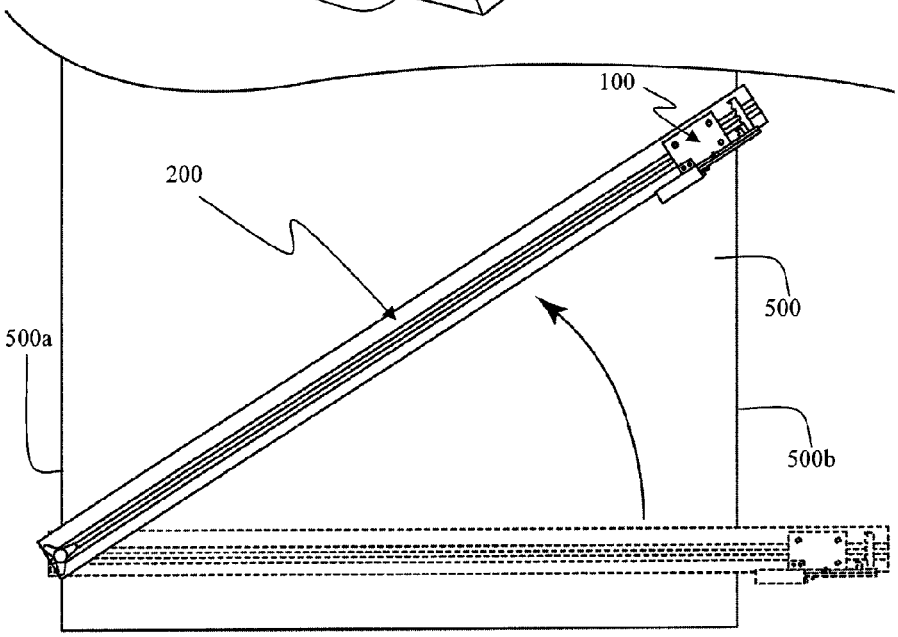

Other features of the invention will emerge from the following detailed description, given with reference to the appended figures which represent, respectively:

FIGS. 1 to 3, left side perspective schematic views of a first embodiment of a carriage according to the invention in three different cutting positions;

FIGS. 4 to 6, right side perspective schematic views of the first embodiment of a carriage according to the invention respectively in the three cutting positions of FIGS. 1, 2 and 3;

FIGS. 7 to 10, perspective schematic views of an implementation of the cutting method according to the invention;

FIG. 11, a partial enlargement in perspective of FIG. 23 illustrating the surface condition obtained after trimming of the edge of the sheet of plasterboard;

FIG. 12, a left side perspective schematic view of a second embodiment of a carriage according to the invention;

FIG. 13, a cross-sectional schematic view of a cutter blade illustrating the state of the art;

FIG. 14, a plan schematic view of a first embodiment of a blade according to the invention;

FIG. 14*a*, a plan schematic view of a variant of the blade of FIG. 14;

FIG. 15, a cross-sectional schematic view along the line XV-XV of the blade of FIG. 14;

FIGS. 16 and 17, plan schematic views of two embodiments of a blade according to the invention;

FIG. 18, a perspective partial schematic view of the blade of FIG. 17;

FIGS. 19 to 21, plan schematic views of three other embodiments of a blade according to the invention;

FIG. 22, a perspective partial schematic view seen from above, relative to the position of use, of a cutting guide according to the invention;

FIG. 23, a perspective schematic view seen from above, relative to the position of use, of a cutting guide according to the invention;

FIG. 24, a perspective partial enlargement of FIG. 23 showing a first embodiment of means for securing the guide according to the invention on the sheet of plasterboard;

FIG. 25, a perspective schematic view of a second embodiment of means for securing the guide according to the invention on the sheet of plasterboard;

FIGS. 26 to 28, perspective schematic views of three embodiments of one end of a cutting guide according to the invention; and FIG. 29, a plan schematic view of a step of implementing a cutting guide according to the invention.

DETAILED DESCRIPTION OF THE INVENTION

FIG. 1 illustrates a first embodiment of a carriage for cutting a sheet of plasterboard according to the invention. The carriage 100 comprises a chassis 101 provided with means for cooperating in a sliding manner with a cutting guide 200. The cooperation means are, in this embodiment, small wheels 102 provided with a groove 102*a* intended to receive a part 201*a* of a rail 201 borne by the guide 200. Such a guide will be described in more detail in relation to FIG. 22.

The small wheels 102 make it possible to slide the chassis 101 along the rail 201.

The chassis 101 comprises a handle 110 mounted to rotate relative to the chassis 101. The handle comprises a gripping means 111 consisting, in this exemplary embodiment, of a profiled hand-hold.

The handle also comprises a recess 112 (see FIGS. 2 and 3) for a cutting blade 300.

The chassis 101 also comprises a section piece 120 provided with three notches A, B and C. These notches are intended to block the rotation of the handle 110 by virtue of the engagement of a retractable claw 113 borne by the handle. Advantageously, the retractable engaging claw 113 is linked to a tension spring 114 pressing the claw toward the bottom of the notches. Preferably, the claw 113 can be actuated by a trigger 115.

In this way, the user who holds the handle 110 by the hand-hold 111 can retract the claw 113 from the notch in which it is engaged (here the notch A) by pulling, with a finger of the hand placed on the hand-hold 111, the trigger 115, against the tension spring 114. He can then pivot the handle 110 relative to the chassis 101 until the claw 113 is engaged in another notch B (see FIG. 2) or C (see FIG. 3).

By virtue of the section piece 120 and the notches A, B and C, the handle can be positioned in a preset manner in three angular positions by reversible engaging of the retractable claw 113 in the notches.

These notches are arranged on the section piece, such that, in use:

- the first notch A allows the blade 112 to be positioned out of contact with the sheet of plasterboard (see FIGS. 1 and 4);
- the second notch B allows the blade to be arranged at an angle $\alpha$ with a sheet of plasterboard, with sufficient contact with this sheet to score it in order to form a cutting edge (see FIGS. 2, 5 and 7);
- the third notch C allows the blade 300 to be arranged at an angle $\beta$ with the sheet of plasterboard, with sufficient contact with this sheet to trim the cutting edge (see FIGS. 3, 6, 10 and 11).

Preferably, the carriage 100 also comprises a protective housing 130 for the blade 300, when the claw 113 is engaged in the first notch A. In this position, the blade is not in contact with the sheet of plasterboard. This position advantageously constitutes a secure transport position in which the blade is inaccessible to the user who cannot therefore be injured with the blade.

FIGS. 4 to 6 illustrate the cutting carriage illustrated in FIGS. 1 to 3, but seen from the opposite side relative to the section piece 120.

In FIG. 4, the handle 110 is in the transport position illustrated in FIG. 1. The blade 300 borne by the handle is protected by the housing 130 and is not therefore visible in FIG. 4.

In FIG. 5, the handle 110 is in the position illustrated in FIG. 2, that is to say that the claw 113 is engaged in the notch B (not visible in FIG. 5). In this position, the blade 300 borne by the handle 110 forms an angle $\alpha$ with the sheet of plasterboard 500. The blade is in sufficient contact with the sheet 500 to score it in order to form a cutting edge. This step will be described in more detail in relation to FIG. 7.

In FIG. 6, the handle 110 is in the same position as that which is illustrated in FIG. 3, that is to say that the claw 113 is engaged in the notch C. In this position, the blade 300 borne by the handle 110 forms an angle $\beta$ with the sheet of plasterboard 500. In this way, the blade is in sufficient contact with the sheet of plasterboard 500 to trim the cutting edge and, advantageously, to cut the sheet of paper or of cardboard borne by the bottom face of the sheet (the bottom face being the face opposite to that which bears the guide 200 and/or the carriage 100.

By virtue of the section piece 120 provided with notches, the angular positions of the handle are predetermined and preset. Thus, the user does not need to pay attention to the angle of the blade relative to the sheet of plasterboard. All he needs to do is to switch from one notch to the other to obtain the different positions of the blade. His only concern is to move the blade relative to the sheet.

FIGS. 7 to 11 illustrate the operation of the carriage according to the invention described previously.

On a sheet of plasterboard 500, a cutting guide 200 is positioned along the cutting direction desired by the user. Before or after this positioning, the user makes the carriage 100 cooperate in a sliding manner with the cutting guide 200.

Figure 7:
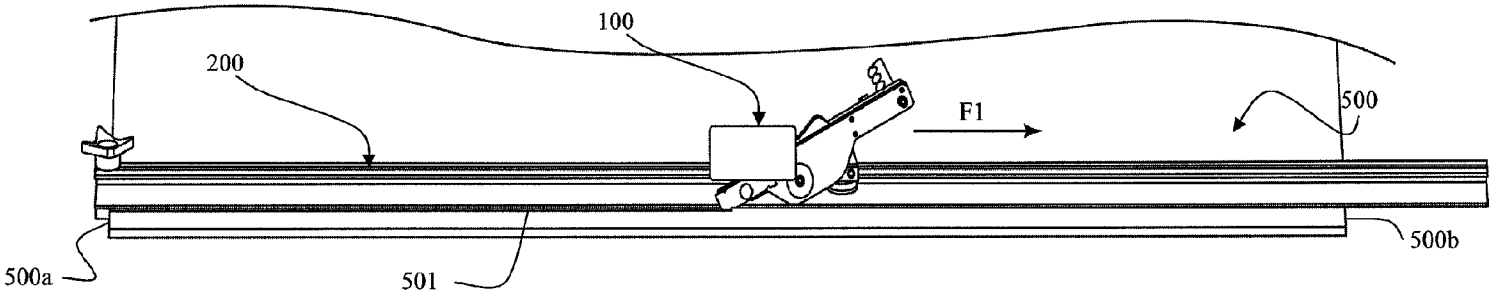
Figure 8:
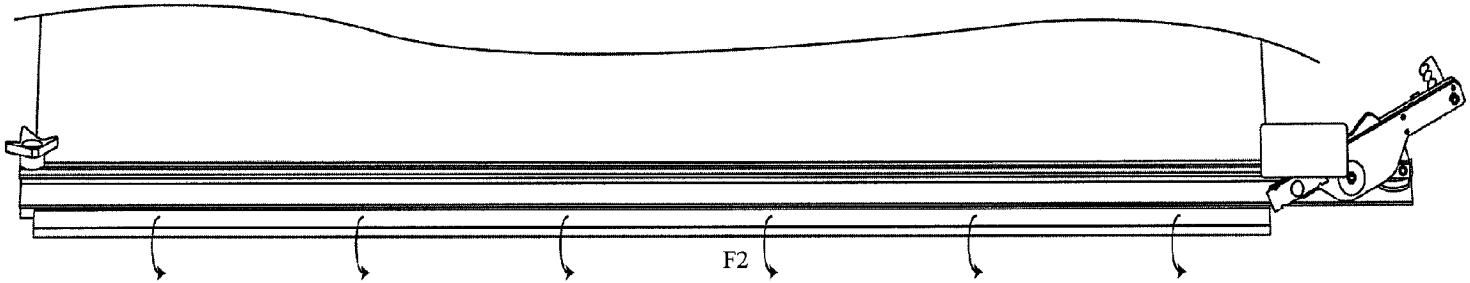

Once the guide is positioned, the user places the carriage at a first edge 500*a* of the sheet 500. In FIG. 7, the first edge is situated on the left; this arrangement is suitable for a use by a right-handed user. This first edge is the one which is located, on the side of the blade of the carriage and opposite the hand-hold of the gripping hand-hold. Then, the user actuates the retractable engaging claw to withdraw it from the notch A of the transport position and pivot the handle until the claw is engaged in the second notch B, so that the blade is in sufficient contact with the sheet to score it. The user then displaces the carriage in the direction of the arrow F1, by pulling the carriage, from the first edge 500*a* of the sheet 500 to the second edge 500*b* of the sheet 500. During this movement, according to the arrow F1, the blade makes a score 501 in the layer of plaster of the sheet 500. If this layer of plaster is covered with a sheet of paper or of cardboard, the blade cuts this sheet at the same time as its score the plaster.

During this movement, the user's only concern is to pull the carriage between the two edges of the sheet to score and cut this sheet. He does not have to worry about the position of the blade or its inclination. By virtue of this, the score is perfectly regular both in its form along the sheet and in its depth.

Having arrived at the second edge 500*b* of the sheet, the user folds the sheet along the score obtained in the preceding step to break the layer of plaster along the score. This folding in the direction of the arrows F2 (see FIG. 8) makes it possible to obtain a cutting edge 502 illustrated in FIG. 9. By virtue of the perfect straightness of the score, the cutting edge obtained is much more even than the cutting edges obtained by the cutter cutting method.

Figure 9:
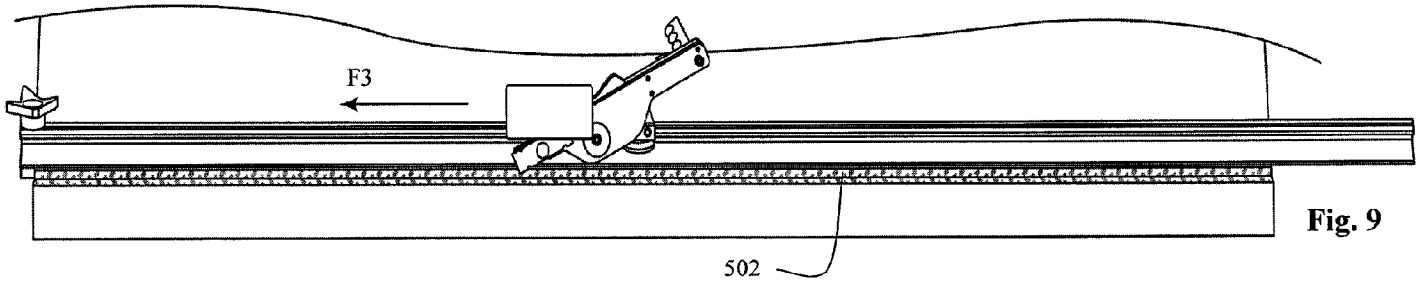

To further improve the flatness of this cutting edge, the carriage according to the invention offers a position of the handle, and therefore of the blade, which makes it possible to trim the cutting edge 502. For this, as illustrated in FIG. 9, the user displaces the carriage using the gripping means from the second edge of the sheet to the first edge of the sheet, according to the arrow F3, then he actuates the retractable engaging claw to withdraw it from the second notch B and pivot the handle until the claw is engaged in the third notch C. In this position, the blade has a trimming edge pressed against the cutting edge obtained in the sheet folding step. The user once again displaces the carriage from the first edge 500*a* to the second edge 500*b*, so that the cutting edge is trimmed by the blade. This step is illustrated in FIGS. 10 and 11. This last FIG. 11 shows the untrimmed cutting edge 502 on the right of the figure and a trimmed cutting edge 502*a* on the left of the figure. Obviously, the cutting edge 503 of the scrap piece 504 from the sheet 500 is not trimmed in this step.

At the same time as the blade trims the cutting edge, it also cuts the sheet of paper or of cardboard positioned on the bottom face of the sheet of plasterboard, if such is present.

During this movement, the user does not have to worry about the position of the blade which is preset by the arrangement of the notch C. This angular position of the third notch C depends on the thickness of the sheet of plasterboard. In the example illustrated, the third notch C is spaced apart from the second notch B to allow for the trimming of a cutting edge of a sheet of plasterboard of a thickness e1 (see FIG. 11).

Advantageously, as illustrated in FIG. 12, the carriage comprises at least one additional notch (the notches D and E) at a distance from the third notch C to allow for the trimming of a cutting edge of a sheet of plasterboard of thickness e2 or e3 that are different from the thickness e1 that can be trimmed when the trigger is engaged in the notch C. In FIG. 12, two additional notches are provided but, obviously, the person skilled in the art will be able to provide others thereof depending on the number of sheet thicknesses intended to be cut by the carriage according to the invention. For example, the notch C could make it possible to trim the edge of a sheet of plasterboard 10 mm thick, the notch D could make it possible to trim the edge of a sheet 13 mm thick (conventionally called, in France, "BA13 sheet") and the notch E could make it possible to trim the cutting edge of a sheet 15 mm thick. Other notches could be provided for other thicknesses.

The implementation described previously is particularly effective when, according to the invention, a blade conforming to FIGS. 14 to 21 is used with the carriage.

Unlike the cutter blade illustrated in FIG. 13 and comprising a doubly beveled cutting edge, the carriage according to the invention advantageously contains a cutting blade 300 comprising at least one scoring corner 301 having, in cross-section, a planar face 300*a* and a beveled face 300*b* (see FIG. 15). The corner is therefore defined by, on one side, a planar face, and on the other side, by a beveled face having two beveled edges 308. The two beveled edges 308 are linked by at least one coupling line 309.

This particular form of the cutting edge of the blade ensures a perfectly rectilinear scoring while preventing the blade from oscillating during the scoring, unlike what is observed with a cutter blade.

The beveled face makes it possible to cut the first sheet of cardboard and score the layer of plaster, and the planar face makes it possible to keep the blade in the same position during the scoring of the plaster. The inventor has observed that it is this maintaining of the position of the blade perpendicular to the sheet of plasterboard which makes it possible to obtain a perfectly rectilinear scoring and a cutting edge that is much more even than when using cutter blades. Since the latter are beveled on each face, it is very difficult, even impossible, even with a guide, to keep the blade in position, so that these cutter blades drift and the cutting edge that is consequently obtained is very uneven.

The best results have been obtained with an angle $\gamma$ between the planar face and the beveled face of between 15 and 25 degrees, and preferably an angle $\gamma$ of 20 degrees. Thus, when the bevel has such an angle, the blade remains perfectly rectilinear and does not oscillate during the scoring. Furthermore, the scoring obtained has a depth and a form such that, when the user folds the sheet of plasterboard (as in FIG. 8), the edge obtained is much more even than that obtained with a cutter blade.

To further enhance the evenness and the flatness of the cutting edge, the blade also comprises a trimming edge 302 which also has a planar face and a beveled face. The trimming edge 302 has a length L1 greater than or equal to the thickness of the sheet of plasterboard. If this thickness is denoted e, the length L1 of the trimming edge must be greater than or equal to: e/sine $\beta$, $\beta$ being the angle between the blade and the sheet of plasterboard when the trigger is engaged in the third notch C of the carriage (see FIG. 6). Obviously, when the carriage comprises more than three notches (see FIG. 12), the length L1 of the trimming edge must be greater than or equal to the thickness of the sheet of plasterboard divided by the sine of the smallest angle $\beta$ of the notches C, D or E.

FIG. 14*a* illustrates a variant of the blade of FIG. 14.

In this variant, the scoring corner 301 has a connecting facet 307 between the two beveled edges 308 of the scoring corner.

The connecting facet 307 is delimited by two coupling lines 309, as well as by a coupling line 309*c* with the beveled face 300*b*. The connecting facet 307 forms a plane making an angle $\delta$ with the planar face 300*a*. The angle $\delta$ is less than the angle $\gamma$ of the beveled edges 308 with the planar face 300*a*. Advantageously, the angle $\delta$ is between 10 and 20, and preferably an angle $\delta$ of 15 degrees. The preferred embodiment is an angle $\gamma$ of 20 degrees and an angle $\delta$ of 15 degrees.

The connecting face 307 facilitates the penetration of the blade into the sheet of plaster during the scoring and limits the forces during the maneuver. Furthermore, the inventor has noticed that the force that is exerted on the scrap part to break the sheet of plaster is also limited.

In practice, the connecting face 307 very substantially enhances the scoring obtained during the scoring step (see FIG. 7). When the connecting face is absent, the single coupling line 309 can rub strongly against the plaster and tear away small pieces of plaster and paper or cardboard during the scoring. The scoring can therefore sometimes exhibit, in particular when the scoring is very rapid, scratches which cause, when the sheet is folded (see FIG. 8), a not very even cutting edge. The connecting face 307 limits the friction between the scoring corner and the sheet, so that the score obtained is particularly even. It exhibits almost no scratches. The cutting edge obtained is very even and presents only very few protrusions, and protrusions of small sizes. The subsequent trimming step is therefore facilitated and constitutes only a finishing to obtain a perfectly planar cutting edge, with no protrusion hindering the positioning of two sheets one against the other.

This variant is applicable to the embodiments illustrated in FIGS. 16 to 21.

In a particularly advantageous embodiment illustrated in FIG. 16, the blade comprises, between the scoring corner 301 and the trimming edge 302, a cutting notch 303. This notch is useful when the sheet of plasterboard comprises a sheet of paper or cardboard on the bottom face of the sheet of plasterboard, in the cutting position. Thus, during the step of trimming the cutting edge, this sheet of paper or of cardboard is engaged in the notch 303 which allows for a clean and sharp cut of this sheet and prevents this sheet from being simply torn. Advantageously, to facilitate this cutting, the cutting notch is curved.

The concomitance of the trimming of the cutting edge and of the cutting of the bottom sheet of paper makes it possible to obtain a cut sheet of plasterboard with none of its sheets of paper torn and for which the cutting edge is free of any protuberance and perfectly parallel to the guide of the carriage used (therefore perfectly rectilinear if the guide is a straight rule). The juxtaposition of a number of sheets of plasterboard cut using the carriage according to the invention is therefore optimized, and the quantity of filler materials for the finishing operations is greatly limited. Furthermore, the fact that the sheets of paper or of cardboard are not torn, avoids having to fill the surface irregularities of the sheet of plasterboard.

In general, on a work site, it is necessary to perform numerous cuts of sheets of plasterboard. All these cuts wear the blade, so that the latter can, during the cutting movements (see FIGS. 7 to 10) become blunt. The scoring is therefore no longer rectilinear and, when the user folds the sheet of cardboard (see FIG. 8), the cutting edge may no longer be perfectly parallel to the guide and may exhibit great unevenness (presence of numerous protuberances). It is therefore necessary to change the blade.

One embodiment of a particularly advantageous blade is illustrated in FIGS. 17 and 18. In this embodiment, the four corners of the plate forming the blade are used as scoring corners. Each of these corners is extended by a trimming edge. Between each corner and the trimming edge, the blade bears a cutting notch. In this embodiment, two diametrically opposite scoring corners 311*a*-311*a* are symmetrical relative to the center of the rectangular plate forming the blade 310. On the other hand, two consecutive scoring corners 311*a*-311*b* have a planar face and an opposite beveled face. This means, as illustrated in FIG. 18, that a scoring corner 311*a* has a beveled top face and a planar bottom face. On the other hand, a scoring corner 311*b* has a planar top face and a beveled bottom face. The same applies for the other structures that are the trimming edges 312*a* and 312*b* and the cutting notches 313*a* and 313*b*.

According to the invention, the blade has a hole 315 intended to cooperate with a bolt provided with a nut 112*a* (see FIG. 11) positioned in the recess 112 for receiving the blade of the carriage 100. The blade 310 also comprises holes 316 intended to cooperate with fixed rods arranged in the recess 112 to secure the blade and prevent it from pivoting about the bolt 112*a*. Obviously, any other means for fixing the blade in the recess can be used, provided that this fixing means firmly secures the blade at right angles to the sheet of plasterboard.

In this way, with a blade according to the invention, the planar face 300*a* of the blade 300 is held at right angles to the sheet of plasterboard during the scoring and trimming.

The embodiment of FIG. 17 makes it possible to use the two scoring corners 311*a* by pivoting the blade about the hole 315 and to use the two scoring corners 311*b* by turning over the blade. Thus, with one and the same blade 310, four scoring and trimming areas are obtained which can be used in succession when one of these areas is worn.

Obviously, as FIGS. 19 and 20 show, the blade may bear only two areas each comprising a scoring corner, a trimming edge and a cutting notch.

FIG. 21 illustrates another embodiment of a blade according to the invention, suited both for left-handed users and for right-handed users. This blade 320 has four scoring corners 321, four trimming edges 322 and four cutting notches 323. In this embodiment, two diametrically opposite scoring corners are symmetrical relative to the center of the rectangular plate and two consecutive scoring corners have one and the same planar face and one and the same beveled face. With this embodiment, it is possible to manufacture a blade that can be used either from the left to the right, or from the right to the left.

To this end, it is possible to provide for the cutting carriage according to the invention to be dismantable and able to be configured either for a right-handed person or for a left-handed person. Thus, the section piece bearing the notches and the handle may be fixed to both sides of the chassis. When there is a protective cap, provision is also made for this cap to be able to be dismantled and fixed either for a right-handed person or for a left-handed person. FIGS. 1 to 6 illustrate a suitable arrangement for use by a right-handed user.

In the embodiment of FIG. 21, the four corners are used to offer, to a right-handed user and to a left-handed user, two cutting areas that can be used in succession when the first to be used is worn. Obviously, it is possible to provide only one cutting area for a right-handed person and only one cutting area for a left-handed person.

The cutting carriage according to the invention comprises, advantageously, means for cooperating in a sliding manner with a cutting guide. A particularly suitable cutting guide has a profiled rail such as that which is illustrated in FIG. 22. In accordance with the invention, the guide of the carriage has two longitudinal edges 200*a* and two ends 200*b*.

In a particularly advantageous embodiment, the guide 200 has a profiled rail 201, intended to cooperate with the small wheels 102 of the carriage (see FIGS. 1 and 22), this rail 201 being extended laterally by flats 202 increasing the contact surface area between the guide and the sheet of plasterboard.

The rail 201 may have any type of form. A particularly advantageous form, illustrated in FIG. 22, allows for a better stability and a better sliding hold of the carriage according to the invention. Around a longitudinal groove 203, the rail 201 comprises two longitudinal protuberances 204. Each of these protuberances has a part 201*a* intended to cooperate in a sliding manner with the small wheels 102 of the carriage 100. Each part 201*a* comprises two non-coplanar rectilinear faces 205-206 linked by a flat 207 substantially at right angles to the contact face 208 of the guide 200 with the sheet of plasterboard.

The flats 202 have, preferably, a width L2 set so that, in use, the cutting blade 300 is in tangential contact with the longitudinal edge 200*a* of one of the flats 202. By virtue of this, the user can easily position the guide since all he needs to do is to align the edge of the flat with the cut marking line previously drawn by the user. Furthermore, the contact between the flat 202 and the blade prevents the latter from oscillating under the action of the movement of the carriage. If the blade used is in accordance with the invention, it is the planar face of the blade which is preferentially applied against the flat 202, and not the beveled face. This further strengthens the guiding of the blade by optimizing the contact surface area between the blade and the guide.

Preferably, the cutting guide according to the invention can have securing means 209 arranged on the face 208 intended to be in contact with the sheet of plasterboard. As illustrated in FIGS. 23 to 25, these securing means may comprise spikes intended to be driven into the plaster of the sheet of plasterboard.

Thus, when the user has positioned the guide in the desired manner, all he needs to do is to press on this guide for the spikes of the securing means to be driven into the sheet and prevent, during the different cutting steps (see FIGS. 7 to 10) the guide from moving from its position of use.

In the embodiment of FIG. 25, the spikes are borne by rods 209*b*.

Advantageously, the securing means are retractable to prevent the spikes from injuring the user when the guide is not in use. In the embodiment of FIGS. 23 and 24, these spikes are borne by screws 209*a*. The screws are preferably inserted into the longitudinal groove 203. When the user wants to use the guide, he withdraws the screws from the plane of the surface 208 using a screwdriver. When the user has finished the cuts, he unscrews the screws until they leave the plane of the surface 208. Advantageously, these screws have a length such that, when they are not screwed, they are held in the groove 203 and prevent the cooperation of the carriage with the rail.

Any other means that can render the spikes retractable can be used in the guide according to the invention.

Preferably, the securing means 209 are arranged on the face 208 of the guide so that, in use, after the cutting of the sheet of plasterboard, the holes formed by the spikes driven into the sheet of plasterboard are situated at a determined distance d from the cut, sufficient for the holes to be filled at the same time as a join between two sheets of plasterboard.

For example, the securing means 209 are arranged at the distance d from the edge 200*a* of the flat 202.

Conventionally, the finishing operations are performed using a coating knife of a width of between 150 mm and 300 mm.

Thus, the spikes of the securing means will preferentially be arranged at a determined distance of between 75 mm and 150 mm, preferably between 70 mm and 120 mm, advantageously between 55 mm and 80 mm, typically 65 mm.

Advantageously, the cutting guide comprises, at least at one of the ends 200*b* of the rail 201, an abutment 210 mounted to rotate relative to the rail 201. Advantageously, the abutment is provided with means for securing, in use, against the sheet of plasterboard. In the embodiment illustrated in FIG. 26, this securing means comprises a spike 211 intended to be driven into the thickness of the sheet of plasterboard. Thus, the user positions the abutment 210 against an edge of the sheet of plasterboard, and secures this abutment against this sheet by driving the spike 211 into the thickness of the sheet of plasterboard. Then, since the abutment 210 is mounted to rotate relative to the rail 201, he can position the guide angularly according to his choice on the sheet of plasterboard as illustrated in FIG. 29.

The securing means may be retractable. For example, a spike 211 is borne by a screw.

Preferably, the rotary mounting of the abutment 210 relative to the rail 201 can be controlled using a thumb wheel 212.

According to a particularly advantageous embodiment, the abutment 210 according to the invention comprises two parts linked to one another by an articulation. This embodiment is illustrated in FIGS. 27 and 28.

In these figures, the abutment 220 comprises a part 221 similar to the abutment 210 of FIG. 26, and a part 222 linked to the part 221 by an articulation 223. The two articulated parts 221 and 222 are provided with means 211 for securing the sheet of plasterboard. In FIG. 27, the securing means of the articulated part 222 comprise spikes 211. In FIG. 28, the securing means comprise a plate 211*a* arranged to allow the sheet of plasterboard to be held between this plate 211*a* and a protuberance 211*b* of the articulated part 222. This arrangement can be obtained by producing the articulated part 222 in a single profiled structure.

The abutment 210 advantageously comprises an end-of-rotation abutment allowing a limited rotation of the articulated parts 221 and 222. In practice, the end-of-rotation abutment advantageously limits the rotation between 0 and 45 degrees, and preferably between 0 and 30 degrees.

By virtue of these articulated parts of the means for securing the sheet of plasterboard, and of the end-of-rotation abutment, the user can on his own perform a cut of a sheet of plasterboard of large size with no risk that the scrap piece 504 (see FIG. 11) will fall during the trimming step, thus tearing the bottom sheet of paper and/or being broken.

In practice, when the user breaks the sheet along the score (see FIG. 8) and commences the trimming of the cutting edge (see FIGS. 10 and 11), the end of the scrap piece 504 already freed is held by the articulated part 222.

According to other embodiments that are not illustrated, the rail of the guide may comprise a retractable stop means to allow, in use, the coupling and the decoupling of the rail with respect to the carriage. Thus, when the carriage is coupled to the rail, the retractable stop means prevents, in the movement, the carriage from leaving the rail. After use, to facilitate transport, it is desirable to decouple the carriage and the rail. The user then deactivates the retractable stop means and removes the carriage from the rail. For example, a pin provided with a return means can be used as retractable stop means.

It is also possible, alternatively or in combination, to provide at least one of the ends of the rail with a means for damping, in use, the sliding of the carriage at end of travel. Thus, the carriage cannot violently strike the retractable stop means or, the carriage cannot violently leave the rail. For example, it is possible to use a spring or a piston as damping means.

The invention claimed is:

1. A carriage for cutting a sheet of plasterboard, characterized in that it comprises a chassis with:

means intended to cooperate in a sliding manner, in use, with a cutting guide;

a handle, mounted to rotate relative to the chassis, and comprising a gripping means, a retractable engaging claw, and a recess intended to receive, in use, a cutting blade;

a section piece provided with at least three notches for blocking the rotation of the handle in three angular positions by a reversible engagement of the retractable claw, the notches being arranged on the section piece such that, in use:

the first notch allows the blade to be retracted away from contact with the sheet of plasterboard;

the second notch allows the blade to be arranged at an angle α with the sheet of plasterboard, with sufficient contact with the sheet of plasterboard to score it in order to form a cutting edge;

the third notch allows the blade to be arranged at an angle β with the sheet of plasterboard, with sufficient contact with the sheet of plasterboard to trim the cutting edge.

2. The carriage as claimed in claim 1, in which the retractable engaging claw is linked to a tension spring pressing, in the rest position, the claw into a notch.

3. The carriage as claimed in claim 1, also comprising a blade protection housing, when the claw is engaged in the first notch.

4. The carriage as claimed in claim 1, in which the third notch is spaced apart from the second notch to allow for the trimming of a cutting edge of a sheet of plasterboard of a first thickness.

5. The carriage as claimed in claim 1, comprising at least one additional notch at a distance from the third notch to enable the trimming of a cutting edge of a sheet of plasterboard of at least one second thickness.

6. The carriage as claimed in claim 1, in which the recess contains a cutting blade comprising at least one scoring corner having a planar face and a beveled face, extended by at least one trimming edge having a planar face and a beveled face that are identical to those of the scoring corner.

7. The carriage as claimed in claim 6, in which the blade also comprises at least one cutting notch arranged between the scoring corner and the trimming edge.

8. The carriage as claimed in claim 6, in which the beveled face of the blade forms an angle (γ) with the planar face of between 15° and 25°, preferably 20°.

9. The carriage as claimed in claim 6, in which the trimming edge has a length greater than the thickness of the sheet of plasterboard.

10. The carriage as claimed in claim 7, in which the cutting notch is curved.

11. The carriage as claimed in claim 7, in which the blade consists of a rectangular removable plate having two faces and comprising:

four scoring corners;

four cutting notches;

four trimming edges, two diametrically opposite scoring corners being symmetrical relative to the center of the rectangular plate, two consecutive scoring corners having a planar face and a beveled face that are opposite.

12. A kit for cutting a sheet of plasterboard comprising:

a carriage as claimed in claim 1;

a cutting blade comprising at least one scoring corner having a planar face and a beveled face, extended by at least one trimming edge having a planar face and a beveled face that are identical to those of the corner;

a cutting guide having two longitudinal edges and two ends, and comprising at least one rail suitable for cooperating in a sliding manner, in use, with the carriage provided with the cutting blade in order, in use, to guide the cutting blade in a manner parallel to the guide, and comprising, at least at one end of the rail, an abutment mounted to rotate and of profiled section to secure, in use, the sheet of plasterboard.

13. A kit for cutting a sheet of plasterboard comprising:

a carriage as claimed in claim 6;

a cutting guide having two longitudinal edges and two ends, and comprising at least one rail suitable for cooperating in a sliding manner, in use, with the carriage provided with the cutting blade in order, in use, to guide the cutting blade in a manner parallel to the guide, and comprising, at least at one end of the rail, an abutment mounted to rotate and of profiled section to secure, in use, the sheet of plasterboard.

14. The cutting kit as claimed in claim 12, in which the rail and the abutment are provided with means for securing the abutment on the sheet of plasterboard.

15. The cutting kit as claimed in claim 14, in which the securing means are spikes intended to be driven into the sheet of plasterboard.

16. The cutting kit as claimed in claim 12, in which the guide also comprises, at at least one of its ends, a retractable stop means to allow, in use, for the coupling and decoupling of the rail with respect to the carriage.

17. The cutting kit as claimed in claim 12, in which the guide comprises, at at least one of its ends, a means for damping, in use, the sliding at the end of travel of the carriage.

18. The cutting kit as claimed in claim 12, in which the abutment comprises two parts linked to one another by an articulation, the two articulated parts being provided with means for securing the sheet of plasterboard, the articulation comprising an end-of-rotation abutment allowing a relative rotation of the articulated parts up to 45 degrees, preferably up to 30 degrees.

19. A method for implementing a kit as claimed in claim 12, for cutting a sheet of plasterboard, characterized in that it comprises the following steps:

a) providing a sheet of plasterboard comprising a layer of plaster and at least one sheet of cardboard or of paper;

b) having the carriage cooperate in a sliding manner with the cutting guide;

c) arranging the cutting guide between two edges of the sheet in a determined cutting direction, and placing the carriage at a first edge of the sheet;

d) actuating the retractable engaging claw to withdraw it from the notch in which it is engaged and pivoting the handle until the claw can be engaged in the second notch (B), so that the scoring corner of the blade is applied to the sheet;

e) displacing the carriage using the gripping means to score the layer of plaster along the determined cut, from the first edge of the sheet to the second edge of the sheet;

f) bending the sheet along the score obtained in the preceding step to break the layer of plaster along the score and obtain a cutting edge;

g) displacing the carriage using the gripping means to the first edge of the sheet;

h) actuating the retractable engaging claw to withdraw it from the second notch and pivot the handle until the claw can be engaged in the third notch, so that the trimming edge is applied against the cutting edge obtained in the step f);

i) displacing the carriage using the gripping means to trim the cutting edge, from the first edge of the sheet to the second edge of the sheet, the step e) and/or the step i) comprising a cutting of said at least one sheet of cardboard or of paper of the sheet of plasterboard.

* * * * *

UNITED STATES PATENT AND TRADEMARK OFFICE

CERTIFICATE OF CORRECTION

PATENT NO. : 9,067,339 B2
APPLICATION NO. : 13/642378
DATED : June 30, 2015
INVENTOR(S) : Mallet It is certified that error appears in the above-identified patent and that said Letters Patent is hereby corrected as shown below:

In the claims:

Column 12,
Line 65, "chassis with" should read --chassis provided with--.

Signed and Sealed this
Fifteenth Day of March, 2016

Michelle K. Lee

Michelle K. Lee
*Director of the United States Patent and Trademark Office*